US007874509B2

(12) United States Patent
Kenney

(10) Patent No.: US 7,874,509 B2
(45) Date of Patent: Jan. 25, 2011

(54) AUTOMATED DISPENSER

(76) Inventor: James W. Kenney, 2822 N. Kent Rd., Broomall, PA (US) 19008

( * ) Notice: Subject to any disclaimer, the term of this patent is extended or adjusted under 35 U.S.C. 154(b) by 1072 days.

(21) Appl. No.: 11/402,605

(22) Filed: Apr. 12, 2006

(65) Prior Publication Data

US 2007/0241160 A1 Oct. 18, 2007

(51) Int. Cl.
*B65H 43/00* (2006.01)
*B65H 20/02* (2006.01)
*B65H 63/00* (2006.01)

(52) U.S. Cl. ..... 242/563.2; 242/563; 242/564.4

(58) Field of Classification Search ..... 242/563, 242/563.2, 564, 564.1, 564.4; 312/34.8
See application file for complete search history.

(56) References Cited

U.S. PATENT DOCUMENTS 4,284,221 A * 8/1981 Nagel et al. ..... 225/100
4,666,099 A * 5/1987 Hoffman et al. ..... 242/564.1
4,688,708 A * 8/1987 Irvine et al. ..... 225/100
4,997,119 A * 3/1991 Meschi ..... 225/100
5,141,142 A * 8/1992 Ramsey ..... 225/4
5,335,811 A * 8/1994 Morand ..... 221/45
5,452,832 A * 9/1995 Niada ..... 225/11
5,549,233 A * 8/1996 Clauser ..... 225/100
5,836,498 A * 11/1998 Turek ..... 225/1
5,862,968 A * 1/1999 Traise ..... 225/100
6,069,354 A * 5/2000 Alfano et al. ..... 250/221
6,293,486 B1 * 9/2001 Byrd et al. ..... 242/564.1
6,419,136 B2 * 7/2002 Formon et al. ..... 225/14
7,191,977 B2 * 3/2007 Denen et al. ..... 242/563.2
7,201,343 B2 * 4/2007 Mabit ..... 242/419.5
7,237,744 B2 * 7/2007 Morris et al. ..... 242/560.1
7,398,944 B2 * 7/2008 Lewis et al. ..... 242/563
7,523,885 B2 * 4/2009 Lewis ..... 242/563
2002/0117528 A1 * 8/2002 Turek ..... 225/4
2002/0117578 A1 * 8/2002 Denen et al. ..... 242/563
2003/0132261 A1 * 7/2003 Formon et al. ..... 225/2
2003/0167893 A1 * 9/2003 Morris et al. ..... 83/649
2004/0251375 A1 * 12/2004 Denen et al. ..... 242/563
2008/0099595 A1 * 5/2008 Lewis et al. ..... 242/560
2009/0057478 A1 * 3/2009 Conner ..... 242/564

* cited by examiner

*Primary Examiner*—Evan H Langdon
(74) *Attorney, Agent, or Firm*—Joseph M. Konieczny, Sr.; Ryder, Lu, Mazzeo & Konieczny

(57) ABSTRACT

A device for dispensing a rolled web of material having a plurality of laterally-extending, longitudinally-spaced lines of perforation. The device has a frame for supporting the rolled web such that lengths of the web are removed from the roll in a direction of advancement as the roll rotates. An infeed roller pair is rotatably mounted on the frame. The infeed roller pair provides a nip therebetween for receiving the web from the roll and for moving it forward in the direction of advancement. A pair of delivery rollers is rotatably mounted on the frame in spaced relation with the first pair of rollers. The second pair of rollers receives the web from the first roller pair and provides a nip therebetween for moving the web in the direction of advancement. Motor means drives the infeed roller pair and the delivery roller pair. Brake means is affixed to the infeed roller pair for slowing the rotational speed thereof relative to the delivery roller pair whereby sufficient tension is created in a length of web located between said roller pairs to tear the web across one of the lines of perforation. Actuation means selectively actuates the brake means during advancement of the web by the delivery rollers.

8 Claims, 4 Drawing Sheets

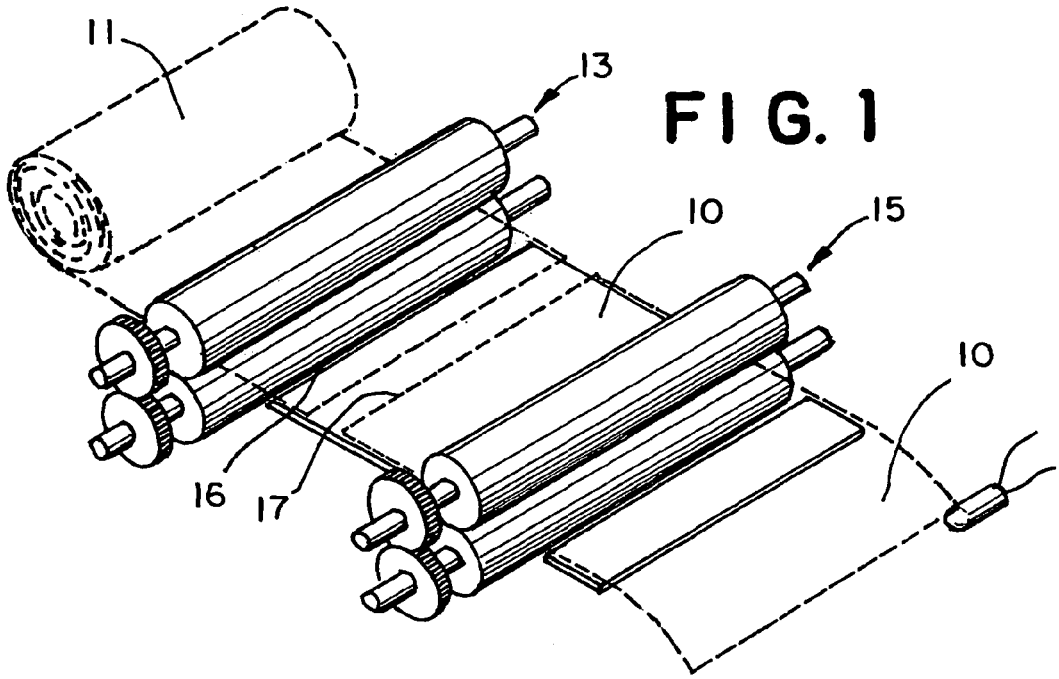
FIG. 1
FIG. 2
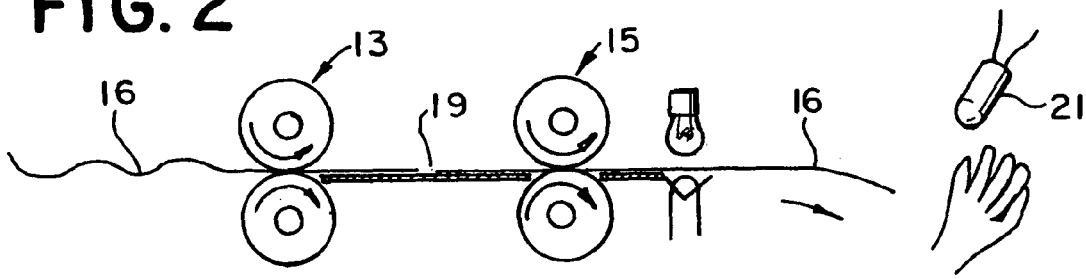
FIG. 3
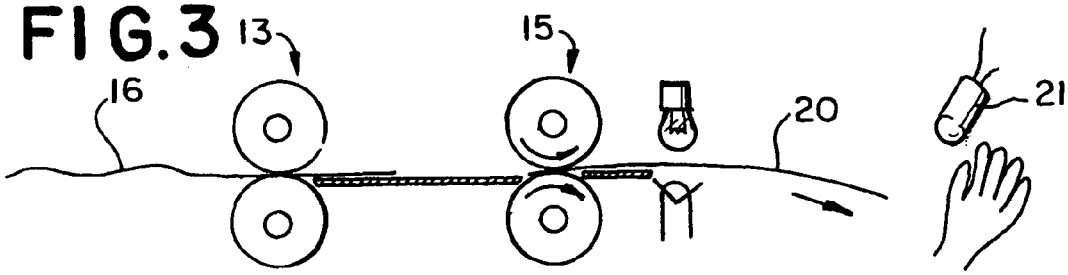
FIG. 4
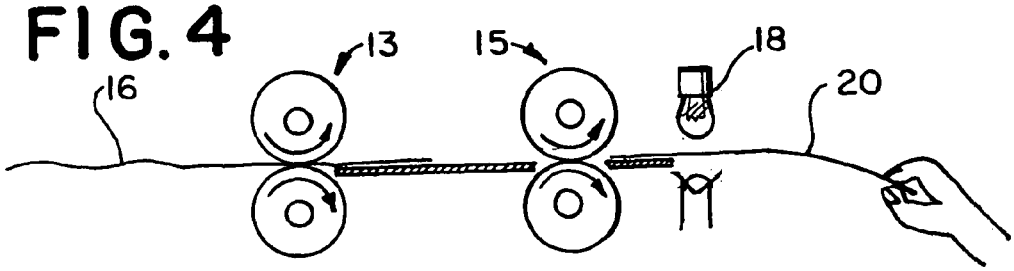

AUTOMATED DISPENSER

FIELD OF THE INVENTION

The present invention relates to a dispensing system for a continuous web of material. More specifically, it relates to a paper towel dispenser for a continuous roll of perforated paper that permits any length equal to a multiple of unit lengths between roll perforations to be selectively dispensed.

BACKGROUND OF THE INVENTION

The most commonly used paper dispenser found in the home is a simple toilet paper bar and/or a two sided paper towel bracket. To dispense the paper, the user pulls on the paper until he or she dispenses the desired amount and then rapidly jerks and tears the paper at the next perforation.

Motorized paper towel dispensers are commonly found in commercial environments. Motorized dispensers usually hold a large roll of non-perforated paper supplied by commercial vendors. Some of these motorized dispensers dispense paper when they detect motion or the presence of a hand. Most automated machines dispense only a pre-determined amount of paper and will not dispense additional paper until the first piece is removed. Since the paper in these machines has no perforations, all machines of this type require the user to tear off the dispensed amount.

In other automated dispensers where the supply paper roll is non-perforated, a cutting device must be included in the dispenser such as is disclosed for example in U.S. Publication 2002/0033405 published by Gergek. The problem with the Gergek device, however, is presented by the added complexity of the perforating or cutting mechanism.

Other patent art of which the applicant is aware are U.S. Pat. No. 4,666,099 issued to Hoffman et al. entitled "Apparatus for Dispensing Sheet Material"; U.S. Pat. No. 5,335,811 issued to Morand entitled "Perforated Paper Towel Dispenser"; U.S. Pat. No. 5,452,832 issued to Niada entitled "Automatic Dispenser for Paper Towels Severable from a Continuous Roll"; U.S. Pat. No. 6,069,354 issued to Alfano et al. entitled "Photonic Paper Product Dispenser"; U.S. Pat. No. 6,293,486 issued to Byrd et al. entitled "Hands-Free Paper Towel Dispensers"; U.S. Publication 2003/0132261 published by Formon et al. entitled "Paper Towel Dispenser"; and 2003/0167893 published by Morris et al. entitled "Apparatus and Methods Usable in Connection with Dispensing Flexible Sheet Material from a Roll." However, none of these devices dispenses ordinary pre-perforated paper products in a selectable desired length by separating that length from the supply roll in an automated fashion without undue mechanical complexity.

SUMMARY OF THE INVENTION

The present invention meets the need in the art for an improved automated paper dispenser. In one embodiment, basic elements of the invention comprise two drive roller pairs: an infeed roller pair and a delivery roller pair. The roller pairs are sized in length to accommodate the width of the supply paper roll. As will be more fully described below, a length of paper web is initially advanced through both roller pairs at the same speed. When the desired length has been observed, the infeed rollers are disengaged from the drive mechanism and braked. The slowed infeed rollers apply a drag force on the paper supply roll sufficient to create tension in the web between the braked infeed rollers and the delivery roller pair, which continues to run at its normal speed. This tension causes the web to tear along the last perforation line to enter the span between the two roller pairs. The delivery rollers continue to run until the passage of the trailing edge of the web is detected and thus completing the process. In one embodiment, the actuator is a spring-biased electromechanical mechanism that is pushed by hand in order to mechanically engage and electrically drive both roller pairs. When the actuator is released, the infeed rollers are disengaged and braked to reduce their speed. The various switches, levers and other mechanisms to achieve this effect are described in detail with regard to a preferred embodiment which follows.

In a second embodiment, separate direct drive motors are applied to each roller pair and the speed of the motors is regulated by electrical circuitry that includes either electromechanical switches operated by the user or remote sensing devices. Here, the action of the roller pairs is preferably controlled by individual electric motors coupled to each roller pair by worm gears mounted on each of the motor drive shafts. In this embodiment, the tearing of the web is accomplished by the drag force applied to the infeed roller pair by cutting the amount of power to the electric motor which drives that roller pair. The drag force is supplied by the internal friction of the drive pair and motor components. Alternatively, if a worm gear drive is used, the drag is supplied reducing the power to the infeed roller pair. Furthermore, in either method of drive gearing, current to the motor of the infeed roller set may be reversed to provide electromagnetic braking to more quickly slow the infeed rollers to effect a quicker tearing of the advancing web.

More specifically, the applicant has devised a dispenser for a roll of paper product comprising a rolled web having a plurality of laterally extending, longitudinally spaced lines of perforation; a frame for supporting the rolled web such that the web is removed from the roll in a direction of advancement as the roll rotates; first advancement means for receiving the web from the roll and for moving it forward in the direction of advancement; second advancement means for receiving the web from the first advancement means and moving the web in the direction of advancement; brake means for slowing the speed of the first advancement means relative to the second advancement means whereby tension is created in a length of web located between the first and second advancement means sufficient to tear the web across one of the lines of perforation; motor means for driving the first and second advancement means; and means for selectively actuating the brake means during the advancement of the web by the second pair of rollers. An infeed roller pair provides the first advancement means and a pair of delivery rollers provides the second advancement means.

The rollers are transversely and rotatably mounted on a frame, which comprises two spaced parallel frame members. The rollers are driven by pulleys. A drivetrain between the motor and the first pulley includes a second pulley affixed to one of the rollers of the delivery roller pair, both pulleys being of equal diameter so that the roller pairs are driven at the same speed. The pulleys are coupled by a belt. The brake preferably includes a means to mechanically disengage the driving force from the infeed roller pair that includes a brake roller, which is slidably affixed to a drive shaft at one roller of the infeed roller pair. Actuation of the brake causes the rotor to move axially on the drive shaft and into contact with the side braking surface on one of the frame members. On the opposite side of the brake rotor, outward-facing axial dogs mesh into and out of engagement with like inboard-facing axial dogs on the first pulley of the infeed roller pair drive shaft. The hand-controlled lever moves the brake roller out of engagement with the first pulley and upon further movement into frictional engagement with the frame member. An electrical contact switch is located downstream of the delivery rollers to cut off electrical power to the drive motor when the trailing edge of the dispensed length of web is detected.

In order to reliably direct the leading edge of the paper web between the infeed roller and the delivery roller, paper guides are employed. At least one pair of guides forms boundaries above and below a web path between the roller pairs. The guides are elongate strips extending along the web path between the roller pairs and passing through a gap in the nip of each roller pair, which is formed by an area of reduced diameter of at least one roller of the roller pairs. This allows the web to be advanced forward in a controlled manner without becoming misdirected or jammed. Also, in order to enhance the grip between the rollers and the web, grit may be adhesively affixed to the roller cover in order to provide increased friction with the web. Furthermore, in order to simplify the roller-based delivery system, opposing rollers may be replaced by a flat smooth surface so that the propelling roller nip is provided between one roller and the opposing flat smooth surface.

From the following drawings and description of the preferred embodiment, it will be appreciated by those of skill in the art that the objects of the invention have been achieved. While the present invention will be described with the reference to a specific embodiment, the following description is illustrative of the invention and is not to be construed as limiting the invention. Various modifications to the present invention can be made to the preferred embodiment by those skilled in the art without departing from the true spirit and scope of the invention. It will be noted here that for better understanding like components are designated by the reference numerals throughout the various figures of drawing which follow.

BRIEF DESCRIPTION OF THE DRAWINGS

FIG. 1 is a top left front isometric view of the web advancement system of the invention;

FIGS. 2, 3, and 4 are sequential diagrammatic side elevation views of the advancement of the web;

DESCRIPTION OF PREFERRED EMBODIMENTS

Figure 5:
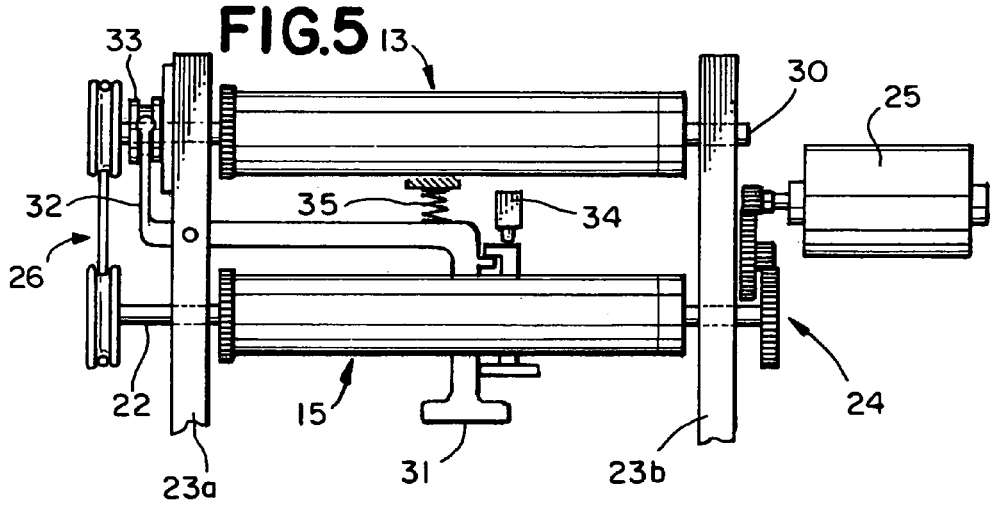
FIG. 5 is a top plan view of the frame-mounted rollers and drive train.

Referring now to FIG. 1, the basic drive elements which feed and dispense individual sheets of paper 10 from roll 11 include a first infeed roller pair 13 and a second delivery roller pair 15. Each roller pair includes driveshafts which are geared together to provide a nip therebetween which propels the web 16 in a direction of advancement, or in the case of roller pair 13, alternatively retards the advancement of the web to provide a tearing force to a line of perforation 17 in the web at a point in the web path between the roller pairs. The web includes lateral spaced lines of perforation to provide areas of weakness where tearing of the web can more easily occur.

Referring now to FIGS. 2, 3, and 4, movement along the web path is diagrammatically shown in three stages. In FIG. 2, the dispensing action has been initiated by the operator's hand coming into proximity with sensor 21. At the desired point when a sufficient length of web 16 has been dispensed, a braking mechanism (not shown) slows the speed of the infeed rollers 13 while the dispensing rollers 15 continue to be driven. This creates tension in the web along the web path between the roller pairs and thus for severance 19 to occur. In FIG. 3, the infeed rollers have come to a stop and dispensing rollers continue to dispense the severed sheet 20. As shown in FIG. 4, dispensing continues until sensor 18 no longer detects presence of the web, i.e. detects the trailing edge of the web. This signals the stoppage of the delivery rollers by cutting off power to the drive motor and completing the dispensing cycle when the sheet 20 is carried away by the user.

Referring now to FIG. 5, the infeed rollers 13 and delivery rollers 15 are rotatably mounted on parallel frame members 23*a* and 23*b*. The rollers are driven by motor means 25 through gearing 24 which provides rotary motion first through a drive shaft 22 of one of the delivery rollers to the opposite side of the frame and then through a pulley and belt drive mechanism 26 to one of the drive shafts 30 of the infeed roller pair 13. Manual actuation lever 31 is pivotally mounted to frame member 23*a*. The end of the actuator includes a forked lever arm 32 which cooperates with a throw-out bearing 33 to move a clutch/brake assembly axially on one of the infeed roller drive shafts 30. The assembly is shown in greater detail with regard to FIGS. 7 and 8 below. The actuation lever also operates contact switch means 34 to regulate power to the drive motor 25. Spring means 35 biases the actuation lever forwardly in the braked position. The electrical wiring and circuitry needed to provide the functionality described in this embodiment and others which follow will be readily apparent to those of skill in the electrical arts without the need for providing greater detail. As will be described in more detail with regard to FIGS. 6A and 6B, the actuation lever also operates a shut-off mechanism as it contacts switch means 34 to begin operation of the drive motor 25.

Figure 6A:
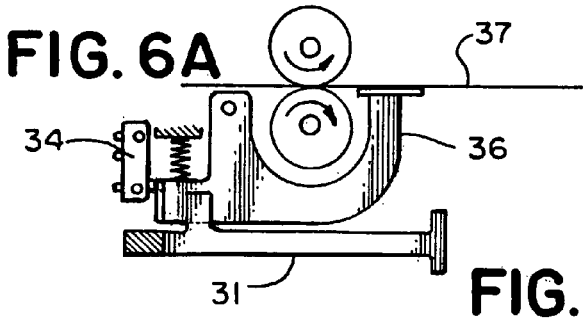
FIGS. 6A and 6B is a left side elevation view of the shut-off mechanism showing sequence of operation.
Figure 6B:
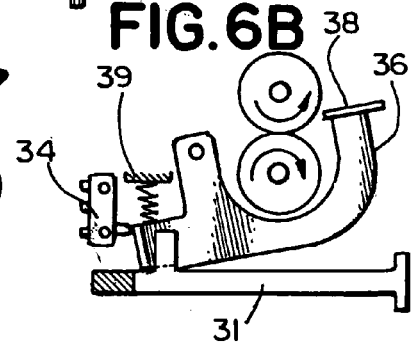

Referring now to FIGS. 6A and 6B, greater detail of the automatic shut-off mechanism is shown. As depicted in FIG. 6A, the application of manual force to the actuation lever has been released and the dispenser is in braking mode but the switch 34 continues to be engaged by the shut-off arm 36 due to the weight of the severed sheet 37. Referring now to FIG. 6B, as dispensing is completed, the dispensed sheet is eventually moved away from the pedal 38 of the arm 36. Downward pressure of the weight of the web is moved off of pedal 38 which permits the spring means 39 to supply sufficient force to raise the pedal and move the shut-off arm 36 away from the contact switch 34. The switch 34 thereby interrupts power to the drive motor which is no longer needed since the web has passed beyond the delivery roller nip.

Figure 7:
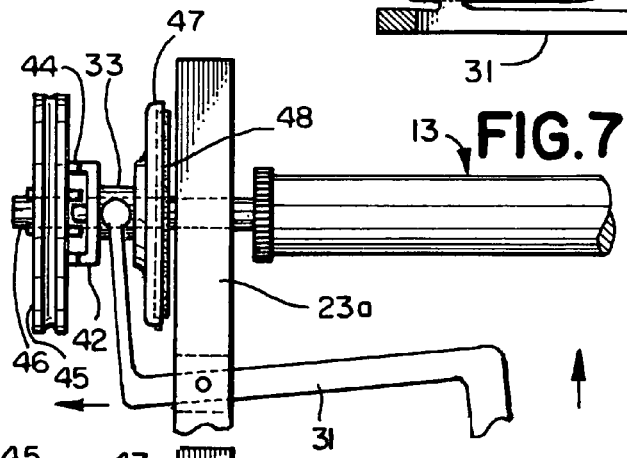
FIGS. 7 and 8 are top plan views of the brake/clutch mechanism in alternate positions of engagement.
Figure 8:
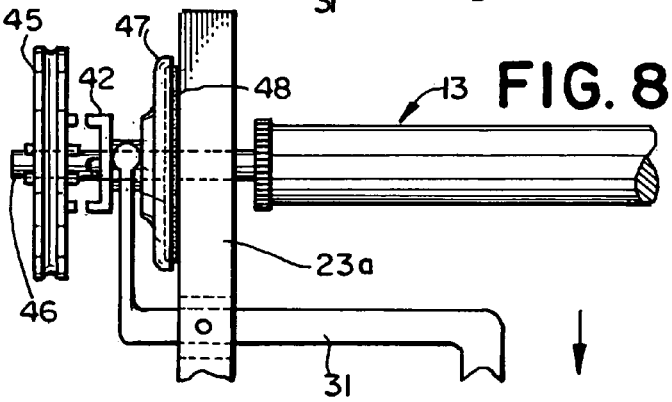

Referring now to FIGS. 7 and 8, details of the actuation lever 31 and the clutch/brake assembly are shown in greater detail. In FIG. 7, the actuation lever 31 is manually pushed backward to initiate dispensing. This moves the throw-out bearing 33 axially outwardly such that a toothed dog 42 on the outboard side of the bearing moves into engagement with a like toothed dog 44 on the inboard face of pulley 45. Shaft 46 is splined and rotatably engaged with inner splines of the clutch brake assembly that includes a disc brake 47 with a brake pad 48 on an outboard surface thereof. When disengaged, however, pulley 45 rotates freely on the shaft. This engagement with the pulley 45 drives the infeed roller pair and the web is drawn from the supply roll and fed in the direction of the dispenser roller pair 13.

Referring now to FIG. 8, when the desired length of dispensed paper is observed, the operator removes pressure from the actuation lever and the lever moves forward to the braked position. This moves the clutch/brake assembly to the right, frictionally engaging the brake pad with an outer surface of frame member 23*a* and simultaneously moving the clutch dogs out of engagement with pulley 45. This action slows and then stops the infeed rollers. As described above, the delivery rollers continue to run at their normal speed, producing tension in the web along the path between the roller pairs that causes a tearing of the web along one of the lines of perforation. To adjust the tension created in the web, the spring means can be adjusted to vary the forward force applied to the actuation lever.

Figure 9:
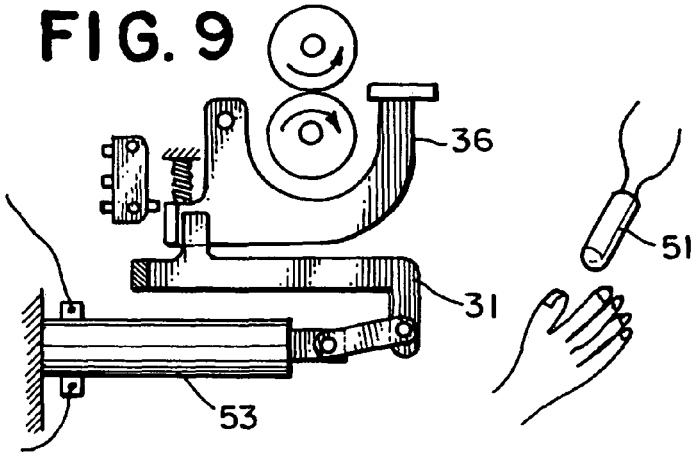
FIG. 9 is a left side elevation view of an alternate powered shut-off mechanism.

Referring now to FIG. 9, the actuation and shut-off mechanisms are depicted but in an alternate powered or automated mode rather than the manual form of actuation described with regard to FIGS. 5-8 above. In this embodiment, a presence sensor 51 delivers power to a solenoid 53 which in turn moves actuation lever 31 so that the dispensing process is initiated as described above. In this embodiment, the shut-off mechanism that includes arm 36 having a web contacting pedal at one end and switch actuation arm at the other end remains the same and functions as described in the previous embodiment.

Figure 10A:
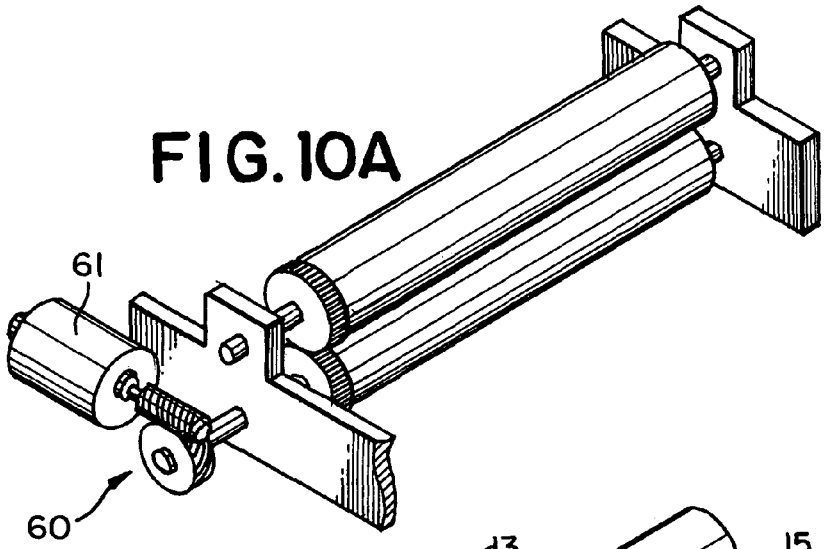
FIG. 10A is a top left front elevation view of an alternate embodiment utilizing a worm gear drive mechanism.
Figure 10B:
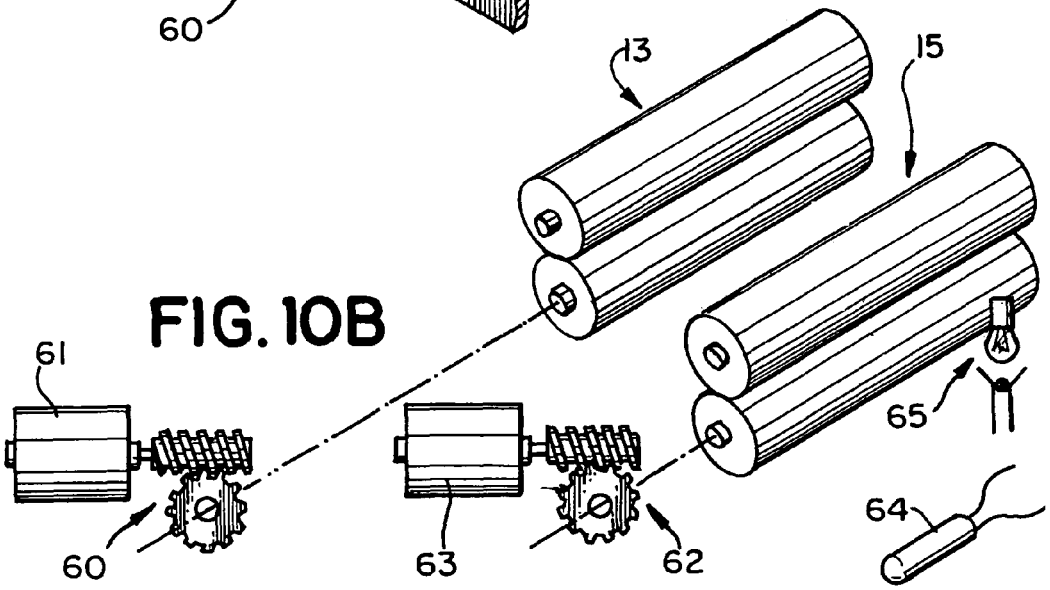
FIG. 10B is a pictorial diagram of the embodiment of FIG. 10A.

Referring now to FIGS. 10A and 10B, the pulley-driven clutch/brake mechanism with mechanical actuation arm and shut-off means described above may be replaced by a more automated embodiment which is fully electrically controlled. In this embodiment, individual drive motors 61 and 63 power each roller pair 13 and 15 separately. Worm gear drives 60 and 62 are preferably utilized to provide an increased back force to the driven rollers in order to counteract their rotational inertia and thus to provide greater control over their motion. In this embodiment, an on/off presence switch 64 initiates operation of both roller pairs at the same speed by providing equal electric current to both drive motors. When the braking effect is required to tear the web, power is reduced or interrupted to the infeed roller motor 63 while power is continued to the delivery roller motor 61. The amount of braking force may be regulated by controlling the power supply to the delivery roller motor 61. This provides the tearing action of the web which continues until sensor pair 65 detects the trailing edge of the web leaving the dispenser at which point power is stopped to both the infeed roller motor 63 and the delivery roller motor 61, thus completing the dispensing cycle.

Figure 11:
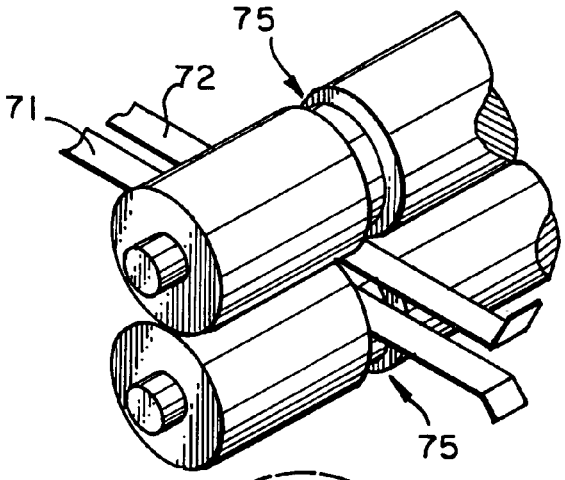
FIG. 11 is a top left front isometric view showing web guides.
Figure 12:
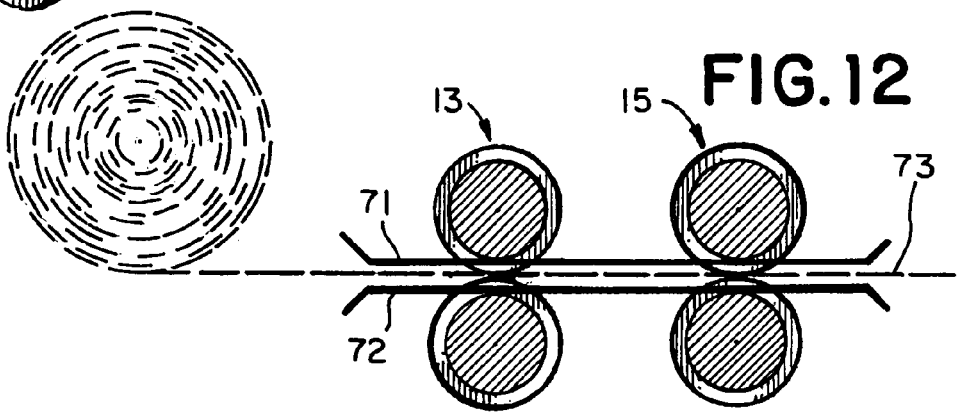
FIG. 12 is a left side sectional view taken from FIG. 11 as shown in that figure.

Referring now to FIGS. 11 and 12, in both embodiments paper guides may be used to control the motion of the web as it passes through the dispensing rollers. Elongate strips 71 and 72 provide boundaries above and below the paper path 73 as it moves through the nip of roller pairs 13 and 15. Each roller includes an area of reduced diameter 75 so that as shown in FIG. 11 a gap is provided to accommodate the paper guides while permitting a path for the web between them in the area of the roller nips.

Figure 13:
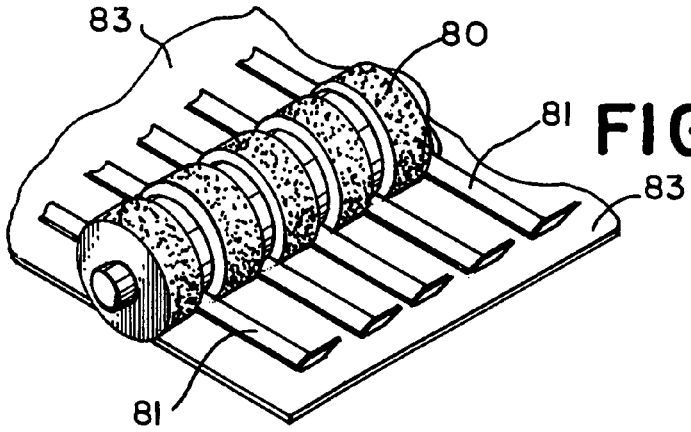
FIG. 13 is a top left front isometric view showing multiple web guides employed in combination with a textured roller and an opposing pressure plate; and, FIG. 14 is a left side elevation sectional view taken from FIG. 13 as shown in that figure.
Figure 14:
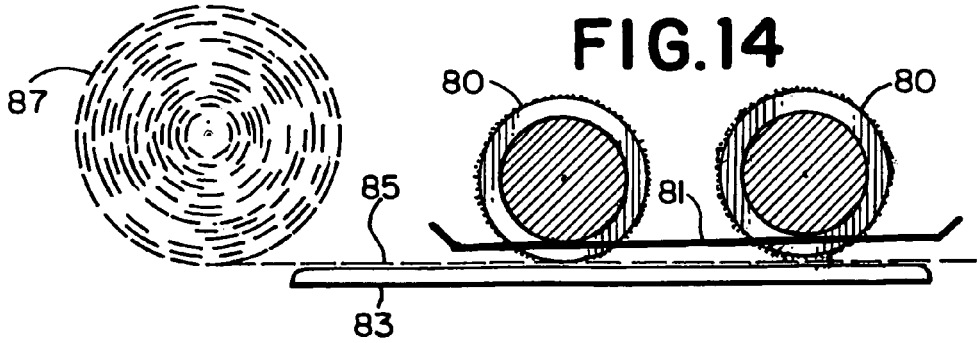

As shown in FIGS. 13 and 14, multiple guides 81 may be employed and the roller surface may be textured with grit 80 for added grip to enhance control over motion of the web. A further modification in this embodiment replaces the second opposing roller of each roller pair with a smooth flat surface 83 against which the rollers rub to provide a forcible nip that propels the web 85 from the supply roll 87 in the direction of rotation of the roller.

It should be understood that there may be other modifications and changes to the present invention that will be obvious to those of skill in the art from the foregoing description, however, the present invention should be limited only by the following claims and their legal equivalents.

The invention claimed is:

1. A device for dispensing a user-defined, variable length of a material from a roll web of the material having a plurality of laterally extending, longitudinally spaced lines of perforation, comprising:

a frame for supporting the rolled web such that lengths of the web are removed from the roll in a direction of advancement as the roll rotates;

a pair of infeed rollers rotatably mounted on said frame providing a nip therebetween for receiving said web from said roll;

a first electric motor coupled to said infeed roller pair for moving the web forward in the direction of advancement;

a pair of delivery rollers rotatably mounted on said frame in spaced relation with said first pair of rollers, said second pair of rollers receiving said web from said first roller pair and providing a nip therebetween;

a second electric motor coupled to said delivery rollers for moving the web in the direction of advancement;

control means for initiating and continuing dispensation of the roll web until the user-defined length of material exits from the device, and then ceasing dispensation; and means for reducing power to the infeed roller motor during advancement of the web by said delivery rollers to create increased tension in the web sufficient to tear the web between the infeed and delivery rollers along a roll perforation;

wherein the user-defined length of material is severed between the infeed and delivery rollers, solely by tension and without optical detection, along the first roll perforation positioned between the infeed and delivery rollers after power to the infeed rollers has been reduced, and is then dispensed from the apparatus by the delivery rollers.

2. The device of claim 1, wherein said motors are connected to said rollers by gearing that includes worm gears mounted on each driveshaft of said first and second motors.

3. The device of claim 1, wherein said control means includes manually operated first switch means for selectively controlling power to said infeed roller motor.

4. The device of claim 3, wherein said first switch means is a proximity sensor.

5. The device of claim 1, wherein said control means includes means for terminating power to said second electric motor by detecting the trailing edge of a dispensed length of web and signaling a second switch means to interrupt an electrical supply to said second motor.

6. The device of claim 5, wherein said ceasing means for detecting comprises a lever in mechanical engagement with said second switch means and which makes contact with the web as it passes out of said delivery rollers.

7. The device of claim 1 wherein at least one roller includes a textured irregular outer surface to provide increased friction with the web.

8. The device of claim 7 wherein said outer surface includes grit adhesively affixed thereto.

* * * * *